United States Patent [19]

Fuchs

[11] 4,343,215

[45] Aug. 10, 1982

[54] PERFORATING CYLINDER

[75] Inventor: Henry O. Fuchs, Annandale, Va.

[73] Assignee: The United States of America as represented by the Secretary of the Treasury, Washington, D.C.

[21] Appl. No.: 186,363

[22] Filed: Sep. 11, 1980

[51] Int. Cl.[3] ..... B26F 1/08

[52] U.S. Cl. ..... 83/670; 83/660; 83/678; 83/698

[58] Field of Search ..... 83/345, 347, 30, 678, 83/660, 669, 670, 698

[56] References Cited

U.S. PATENT DOCUMENTS

| | | | |
|---|---|---|---|
| 617,012 | 1/1899 | Griffin | 83/670 X |
| 1,714,583 | 5/1929 | Anthony | 83/344 |
| 2,674,026 | 4/1954 | St. Palley | 83/698 X |
| 3,174,428 | 3/1965 | Huck | 83/677 X |
| 3,255,651 | 6/1966 | Huck | 83/698 X |
| 3,565,308 | 6/1968 | Slack | 83/660 X |
| 3,779,285 | 12/1973 | Sinibaldo | 83/347 X |
| 3,880,030 | 4/1975 | Rosengren | 83/698 X |
| 4,276,800 | 7/1981 | Koppa et al. | 83/682 X |

FOREIGN PATENT DOCUMENTS

| | | | |
|---|---|---|---|
| 1291590 | 10/1972 | United Kingdom | 83/698 |

*Primary Examiner*—James M. Meister

*Attorney, Agent, or Firm*—Joseph A. Hill; Thomas J. Byrnes; Harry E. Barlow

[57] ABSTRACT

The present invention is a clamping arrangement for the pins of a stamp perforating cylinder. A plurality of cavities are arranged in a checkerboard fashion on the surface of the stamp perforating cylinder. The pins are mounted along the side walls of the cavities and extend radially outwardly from the surface of the cylinder. The pins are held firmly in place within each cavity by a clamping member, a screw and an elastomer ring. The elastomer ring is installed at the base of the cavity and is held in place by the clamping member and screw. The screw and the clamping member coact to compress and displace outwardly the elastomer ring thereby firmly grasping the pins mounted along the side walls and securing the pins against movement. The clamping arrangement provides for retention of the pins while at the same time it permits easy removal and replacement of individual pins.

6 Claims, 5 Drawing Figures

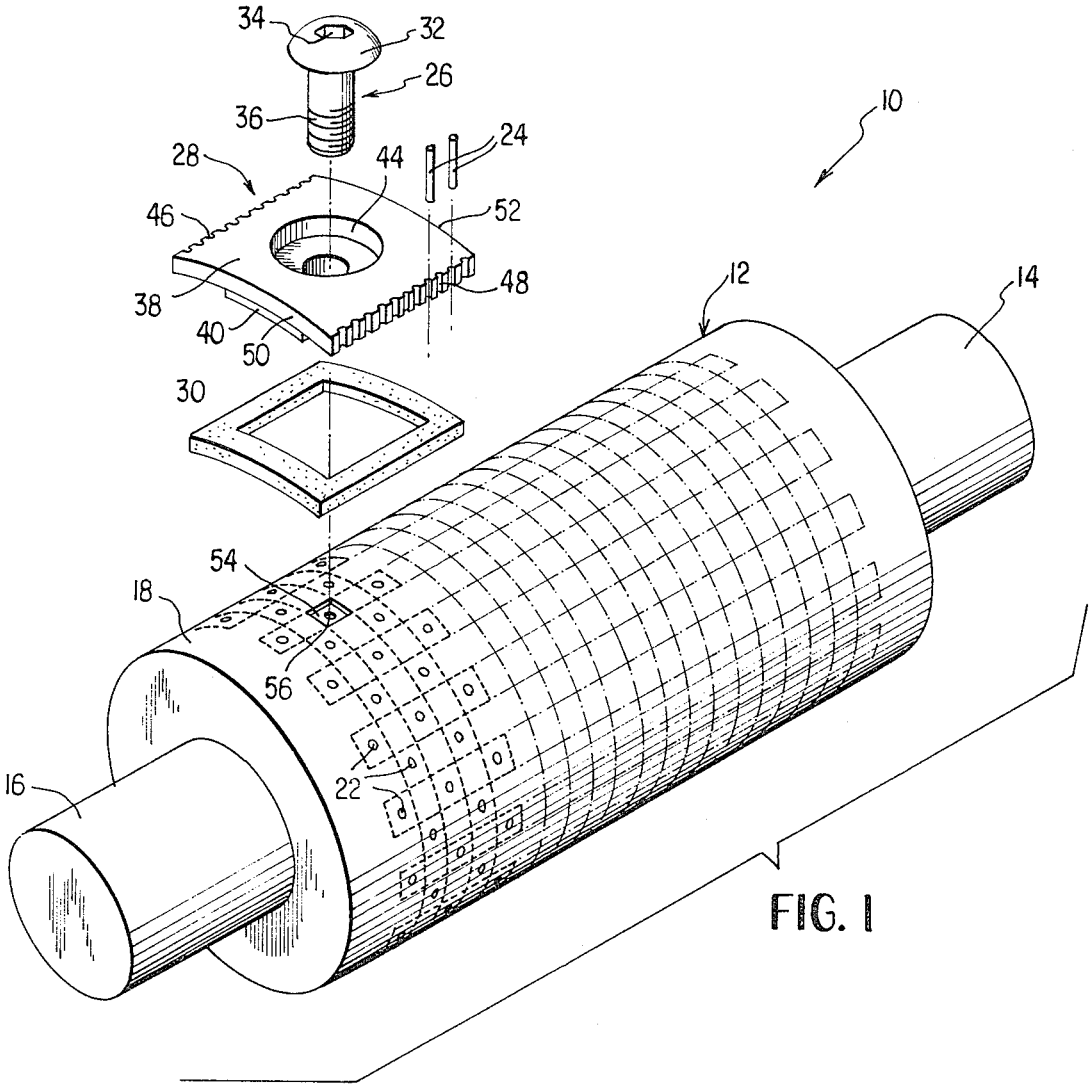
FIG. 1
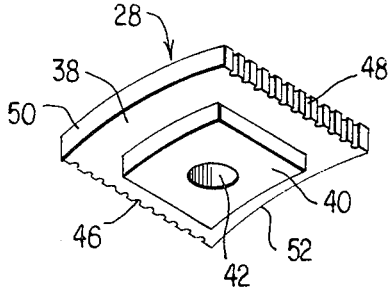
FIG. 2
FIG. 3
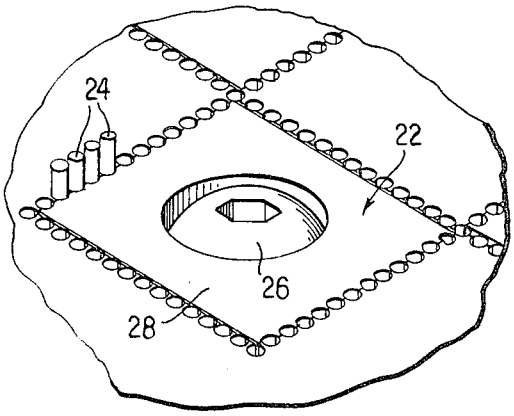

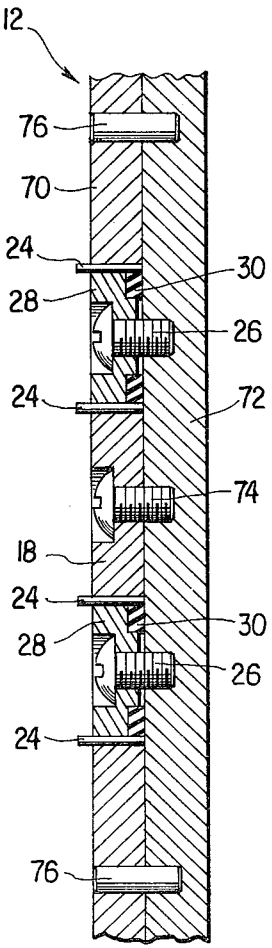
FIG. 5
FIG 4
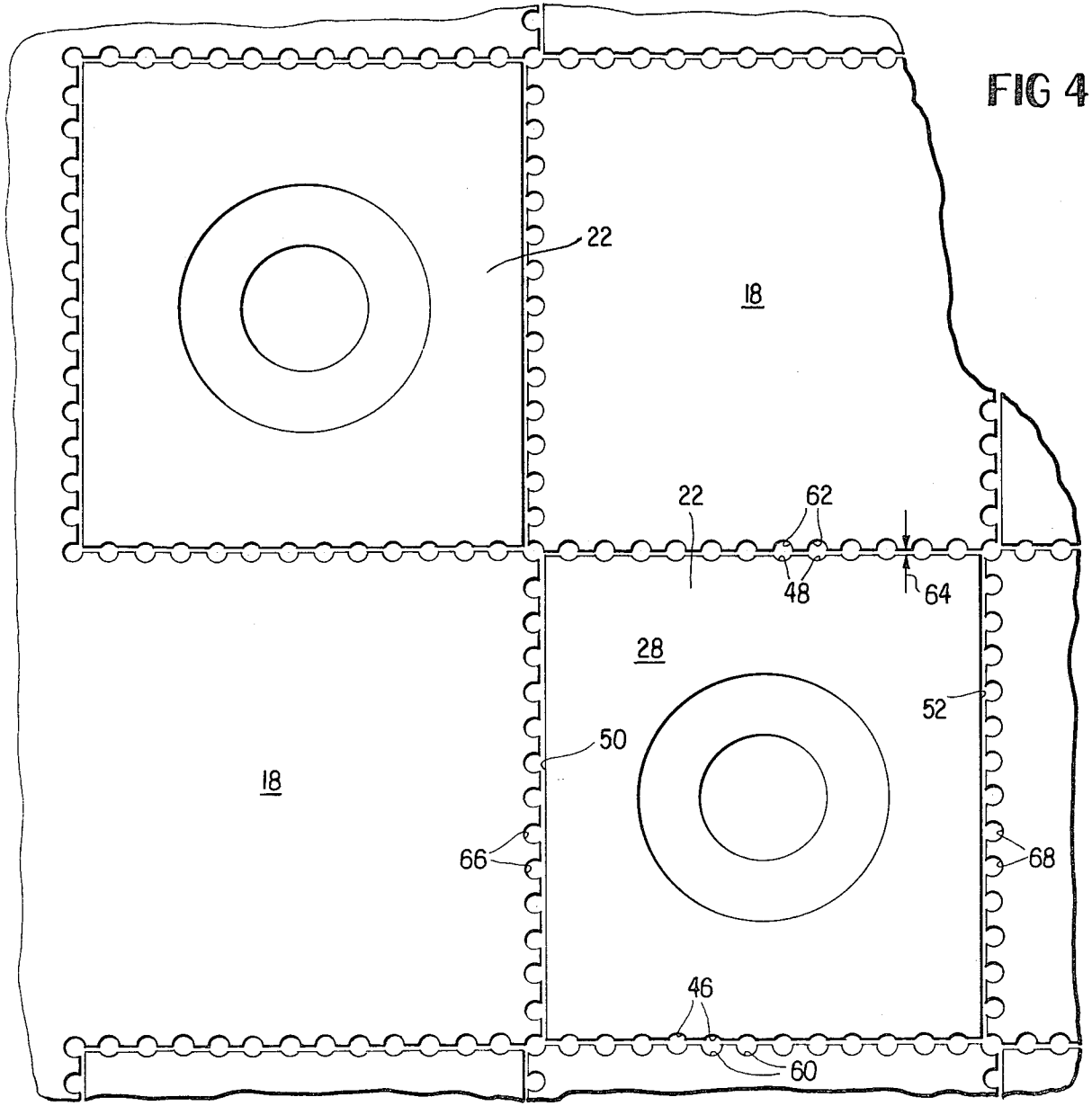

PERFORATING CYLINDER

GOVERNMENT LICENSE

The invention described herein may be manufactured and used by or for the government of the United States of America for governmental purposes without the payment of any royalties thereof or therefor.

BACKGROUND OF THE INVENTION

This invention relates to a perforating cylinder for punching a series of holes in paper material and in particular is directed to a cylinder for perforating postage stamps.

Postage stamps are typically printed at the Bureau of Engraving and Printing from a continuous roll of paper 18½" wide. After printing, the stamps are perforated by a perforating assembly comprising cooperating male and female cylinders. Typical dimensions of either the male or the female cylinder is a diameter of 13" or 14⅜" and a width of 22" or 26".

The male cylinder has from 17,000 to 22,000 protruding pins arranged in symmetrical patterns on its outer surface. The female cylinder has an identically arranged set of holes on its outer surface. As the male cylinder and the female cylinder rotate in unison the protruding pins mesh with the corresponding holes. When the printed stamps are passed between the two rotating cylinders, the coaction of the protruding pins and the corresponding holes provide the desired perforating function.

The pins experience heavy wear and generally fail by getting dull or by breaking off. Either condition results in less than complete perforation of the stamps. A few ramdomly located dull or broken pins can be tolerated, but when several adjacently located pins become defective or when the total number of defective pins becomes excessive, the defective pins must be replaced.

On the prior art perforators, the pin replacement procedure is a lengthy one requiring up to 210 man hours of labor and a down time of approximately 2 days. Because of the unscheduled nature of the down time caused by the pin replacement procedure, the entire manufacturing process is adversely affected and production costs for stamps are driven upward.

SUMMARY OF THE INVENTION

The present invention avoids these difficulties by providing a novel clamping arrangement for retention of the pins in the male perforating cylinder. With the novel clamping arrangement, the perforating pins of each cavity are held in place by a single screw. The removal and replacement of defective pins becomes a much simpler process since any pin can be removed on-site by removing a single screw, and further, non-defective pins retained by other clamps need not be disturbed. Moreover, the clamping arrangement increases the life of the male cylinders and reduces the time for pin replacement to approximately 24 man-hours.

The clamping arrangement of the present invention comprises a specially designed cylinder having a plurality of cavities arranged on the outer surface of the cylinder where each individual cavity further contains an elastomer ring, a clamping member and a screw. The individual cavities may be any desired shape, however, square or rectangular cavities are generally used. The side walls of the cavities are fashioned with spaced apart grooves radially extending from the base of the cavity up to the surface of the cylinder. On one set of opposing walls the spaced apart grooves are substantially semicircular in cross-section while on the remaining set of opposing walls the spaced apart grooves are substantially greater than semicircular in cross-section. The clamping member is of the same general configuration as the cavity and is dimensioned to permit insertion of the clamping member into the cavity. The clamping member has on two opposing edges a set of spaced apart semicircular grooves which correspond to the grooves on the adjacently located edges of the cavity, while the remaining two edges contain no grooves. This clamping member configuration renders the alignment of the grooves less sensitive to the radial position of the member.

Upon insertion of the clamping member into the cavity, the semicircular grooves of the cavities and the corresponding grooves on the edges of the clamping member form a series of substantially circular holes which the pins pass through and which grasp the surface of the pins to retain them. On the remaining two edges, the substantially semicircular grooves cooperate with the straight edges of the clamping member to grasp and retain the perforating pins. In the preferred embodiment, the base of the cavity has installed therein an elastomer ring which can be compressed by the clamping member to provide further gripping action on the pins.

It is therefore one object of the present invention to provide an improved perforating cylinder for paper products.

Another object of the present invention is to provide an improved perforating cylinder for sheets of stamps.

Another object of the present invention is to provide a perforating cylinder where the perforating pins may be simply and quickly removed and replaced.

Another object of the present invention is to provide improved perforating cylinders for U.S. postage stamps having a novel clamping arrangement.

Another object of the present invention is to provide a novel elastomer clamp for the pins of a perforating cylinder.

These and further objects and advantages of the invention will be more apparent upon reference to the following specification claims and appended drawings.

BRIEF DESCRIPTION OF THE DRAWINGS

FIG. 1 is a partially exploded perspective view of a perforating cylinder constructed in accordance with the present invention.

FIG. 2 is an enlarged perspective view of the clamping member which forms a part of the clamping arrangement of FIG. 1.

FIG. 3 is an enlarged view of a portion of the outer surface of the cylinder of FIG. 1.

FIG. 4 is a much enlarged and flattened view of a portion of the cylinder surface which shows the details of the voids.

FIG. 5 is a broken and flattened partial crosssection through the cylinder of FIG. 1.

DESCRIPTION OF THE PREFERRED EMBODIMENT

Referring to the drawings, the novel male perforating cylinder of the present invention is generally indicated at 10 in FIG. 1. The protruding pins of this cylinder are adapted to be received in corresponding holes of a cooperating female perforating cylinder. The female cylinder is not shown in the drawings and forms no part of the present invention.

Cylinder 10 comprises a hollow cylinder 12 having secured to its ends a pair of spindles 14 and 16. Typically the cylinder may have a diameter of 13 inches or 14⅜ inches. The circumference and the length of the cylinder defines an area for punching out various formats of stamps. The format used for stamps is a sheet of paper containing either 200 or 400 subjects. The outer surface area of the cylinder is such that eight sheets of stamps, four sheets around and two across would be required to encircle the cylinder. In the neighborhood of from 17,000 to 22,000 perforating pins typically are installed on the cylinder surface.

FIG. 1 illustrates a series of clamps 22 arranged in a checkerboard pattern on the surface 18 of the cylinder. As shown in the exploded portion of FIG. 1 and in the enlarged views of FIGS. 2 and 3, each of the clamps 22 along with its associated structure secures a plurality of pins 24 and comprises three elements, namely, a screw 26, a clamping member 28 and an elastomer ring 30. The screw has a head 32 with a recess 34 for receiving an Allen-head wrench and has a threaded shank 36. The clamping member 28 comprises a rectangular or square plate 38 and an inwardly-stepped lower portion or boss 40. The plate 38 has an enlarged central aperture 44 adapted to receive the head 32 of screw 26 and includes vertically extending grooves 46 and 48 on two edges. The other two edges 50 and 52 of the plate 38 have smooth surfaces and are not grooved. Elastomer ring 30 is shaped like a square donut with a substantially square cross-section and is formed of suitable elastomeric material having some resiliency. While many suitable elastomers may be used, one particularly suited is that sold under the trade name STYCAST CPA-19 by Emerson & Cummings, Inc., of Canton, Mass. This material is a medium durometer, room temperature curing polyurethane. Clamp 22 is received in a cavity in the surface of the cylinder as illustrated at 54 in FIG. 1, which cavity has a threaded recess 56 adapted to receive the threaded shank 36 of the screw 26.

FIG. 4 shows two of the clamps 22 to a much enlarged scale. The pins and screws are not shown to more clearly illustrate the nature of the vertically extending grooves along the edges of the clamping member 28 and along the adjacent edges of the cavity formed in the cylinder surface 18.

While the plate 38 of FIG. 2 is shown as flat in FIGS. 4 and 5 for the sake of simplicity, it is understood that in actuality it possesses a curvature conforming to the surface of the cylinders 18. The grooves 46 and 48 in the clamping member of FIG. 4 are shown as substantially less than half a circle in cross-section and, as illustrated, are located directly across from corresponding grooves 60 and 62 in the cylinder surface 18. The latter grooves are approximately a half of a circle in cross-section with a clearance between the clamping member 28 and the cylinder surface 18 of 0.010 inch as illustrated at 64. The straight edges 50 and 52 are shown as located across from a first series of grooves 66 and a second series of grooves 68. These latter two sets of grooves are substantially more than a half of a circle in cross-section, this particular cross-section when used in conjunction with straight edges 50 and 52 results in better retention of the pins.

Grooves 46 and 48 are formed on the edges of the clamping member 28 which lie in planes extending radially through the axis of rotation of the cylinder whereas the straight edges 50 and 52 lie in traverse planes rather than in radial planes. This configuration, renders the alignment of the cooperating grooves less sensitive to the radial position of the clamping member 28, which may vary slightly due to variations in the tightness of the screw, the resiliency and the thickness of elastomer ring 30.

FIG. 5 shows in crosssection a portion of the cylinder 12. The crosssection shows a front plate 70 corresponding to the outer cylinder surface 18 and a rear plate 72 joined by a plurality of screws 74 and pins 76.

It is apparent from the above that the present invention provides an improved perforating cylinder which is particularly adapted for perforating the edges of postage stamps. Important features of the invention include a specially arranged set of clamps comprising a resilient elastomer ring in combination with a clamping member and a screw such that when the screw is tightened down the clamping members compresses and displaces the elastomer ring causing the edges of the elastomer ring to move outwardly into engagement with a plurality of pins to tightly grip the pins thereby retaining them in place.

The pins can be quickly and simply removed by loosening the screw to release the pins. The clamps are rectangular in configuation and are approximately the same size and shape as the particular postage stamps being perforated. The edges of the clamp which are not coincident with a plane passing through the axis of rotation (i.e. transverse to the axis of rotation) of the cylinder have smooth surfaces so as to reduce the possibility of misalignment due to variations in the displacement or resiliency of the elastomer ring.

While there has been shown and described an innovation in connection with certain specific embodiments, it will of course be understood that it is not intended nor wished to be limited thereto, since it is apparent that the principles herein disclosed are susceptible of numerous other applications, and modifications may be made in the structural arrangement and in the instrumentalities employed without departing from the spirit and scope of this invention as set forth in the appended claims.

I claim:

1. In a male perforating cylinder for cooperating with a corresponding female perforating cylinder to perforate stamp material comprising a cylinderical surface, a plurality of spaced-apart aligned perforating pins, a means for clamping said plurality of pins to said surface which permits rapid and easy replacement of said pins, said plurality of pins comprising a first plurality of pins oriented to lie in planes passing through the axis of rotation of said cylinder and a second plurality of pins oriented to lie in planes transverse to said axis, said first plurality of pins consisting of the number of pins necessary to perforate a set of opposing edges of a stamp, said second plurality of pins consisting of the number of pins necessary to perforate the set of remaining opposing edges of the stamp, said means for clamping said plurality of pins comprises at least one clamp, said clamp comprising a cavity, an individually removable clamping member, a resilient member, and an attaching means, wherein said cavity comprises a base and four walls, said four walls further comprises a first opposing pair of walls and a second opposing pair of walls, said first opposing pair of said walls are oriented to lie in said planes passing through the axis of rotation of said cylinder and said second opposing pair of said walls are oriented to lie in said planes transverse to said axis, said first opposing pair of walls contains a first plurality of grooves of substantially semicircular cross section, said second opposing pair of walls contains a second plurality of grooves of substantially greater than semicircular cross section, said clamping member includes a first pair of sides with a first plurality of substantially semicircular cross section grooves therein for cooperating with said first plurality of grooves in said first opposing pair of said walls to receive and retain said first plurality of pins, said clamping member further includes a second pair of sides having straight and ungrooved sides for cooperating with said second plurality of grooves in said second opposing pair of walls to receive and retain said second plurality of pins whereby said walls, said resilient means and said clamping member coact to keep said plurality of pins in alignment to permit proper meshing action with said female perforating cylinder.

2. In a male perforating cylinder according to claim 1 wherein said resilient member is installed at the base of said cavity and is held in place by said clamping member and said attaching means.

3. In a male perforating cylinder according to claim 2 wherein said attaching means comprises a screw which is threadedly received into the base of said cavity.

4. In a male perforating cylinder according to claim 3 wherein said resilient member comprises a continuous ring structure having a coaxial void, said ring structure having substantially rectangular cross section.

5. In a male perforating cylinder according to claim 4 wherein said resilient member is composed of an elastomeric material.

6. In a male perforating cylinder according to claim 5 wherein said clamping means further comprises a plurality of clamps and corresponding pluralities of pins are arranged in substantially a checkerboard fashion so as to substantially cover said surface.

* * * * *